US010858144B2

(12) United States Patent
Sin

(10) Patent No.: US 10,858,144 B2
(45) Date of Patent: Dec. 8, 2020

(54) ONE PIECE PACKAGING WITH SIDE GRAPHIC PANEL

(71) Applicant: WestRock Shared Services, LLC, Atlanta, GA (US)

(72) Inventor: Alexander C. Sin, Winston Salem, NC (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/458,297

(22) Filed: Jul. 1, 2019

(65) Prior Publication Data

US 2020/0002050 A1 Jan. 2, 2020

Related U.S. Application Data

(60) Provisional application No. 62/692,900, filed on Jul. 2, 2018.

(51) Int. Cl.
*B65D 5/52* (2006.01)
*B65D 5/22* (2006.01)

(52) U.S. Cl.
CPC ..... *B65D 5/5226* (2013.01); *B65D 5/22* (2013.01)

(58) Field of Classification Search
CPC ..... B65B 43/10; B65D 5/20; B65D 5/2052; B65D 5/22; B65D 5/52; B65D 5/522; B65D 5/5226
USPC ..... 206/736, 767, 768; 229/102.5
See application file for complete search history.

(56) References Cited

U.S. PATENT DOCUMENTS 1,649,211 A * 11/1927 Bitzer ..... B65D 5/522 206/766
5,762,203 A * 6/1998 Klawiter ..... B65D 5/522 206/736
6,886,737 B2 * 5/2005 Dye ..... B65D 5/2047 206/767
9,540,133 B1 * 1/2017 Schomisch ..... B65D 5/68
10,463,176 B1 * 11/2019 Sells ..... B65D 5/308

* cited by examiner

*Primary Examiner* — Bryon P Gehman
(74) *Attorney, Agent, or Firm* — Locke Lord LLP; John Swingle

(57) ABSTRACT

A graphic block package includes a tray configured to package and display product placed therein. A graphic block is foldably connected to the tray, wherein the graphic block includes a set of folding panels configured to collapse the graphic block for shipping and to support the graphic block for retail display.

13 Claims, 5 Drawing Sheets

ONE PIECE PACKAGING WITH SIDE GRAPHIC PANEL

REFERENCE TO RELATED APPLICATION

This application claims the benefit of priority under 35 U.S.C. § 119(e) of U.S. provisional application Ser. No. 62/692,900 filed on Jul. 2, 2018, which is hereby incorporated by reference in its entirety.

BACKGROUND OF THE INVENTION

Field of the Invention

The present disclosure relates to packaging such as for retail display, and more particularly to packaging with graphic panels.

Description of Related Art

In retail settings, it is often desirable to display goods for sale within their packaging, as opposed to using packaging that conceals the goods completely. In packaging that displays the goods within the package, it is desirable to have graphics on the packaging to enhance the display within the retail setting. The graphics can show images the product in use for example. It is advantageous if the display packaging, including the graphics, can be used for shipping as well as for display in the retail setting. Some designs require up to six separate components to be manufactured and assembled together, e.g., to make a telescoping graphic block function on a package.

The conventional techniques have been considered satisfactory for their intended purpose. However, there is an ever present need for improved packaging. This disclosure provides a solution for this problem.

SUMMARY OF THE INVENTION

A graphic block package includes a tray configured to package and display product placed therein. A graphic block is foldably connected to the tray, wherein the graphic block includes a set of folding panels configured to collapse the graphic block for shipping and to support the graphic block for retail display.

In another aspect, a blank for a graphic block package as described above includes a plurality of panels for forming a tray configured to package and display product placed therein. A plurality of panels is included for forming a graphic block foldably connected to the tray for collapse the graphic block for shipping and to support the graphic block for retail display.

The plurality of panels for forming a tray can include a bottom panel, a back panel connected to the bottom panel by a respective fold line, two side panels connected on either end of the back panel by respective fold lines, and a front panel foldably connected to the bottom panel across from the back panel by a respective fold line. At least one of the bottom, side, and/or front panels of the tray can be a compound panel including a respective fold line that can be folded to form a respective double panel. The front and back panels of the tray can be differently sized from one another for display of product in the tray. The first and second side panels can be differently sized from one another.

The folding panels of the graphic block can include a front graphic panel foldably connected a bottom panel of the graphic block, and side panel of the graphic block foldably connected directly to the front graphic panel with an adhesive tab foldably connected to the side panel of the graphic block for foldably connecting the side panel of the graphic block to the bottom panel of the graphic block. The side panel of the graphic block can include a set of foldably connected collapsible panels. A first one of the collapsible panels can be foldably connected to the adhesive tab for connection to the bottom panel of the graphic block. A second one of the collapsible panels can be foldably connected to the front graphic panel so that the collapsible panels can fold inward between the front graphic and bottom panels of the graphic block for shipping, and can unfold outward to form the side panel of the graphic block supporting the front graphic panel in an upright position for retail display of graphics on the front graphic panel. The first one of the collapsible panels can be foldably connected to an adhesive tab that is adhered to the bottom panel of the graphic block, foldably connecting the first one of the collapsible panels to the bottom panel of the graphic block.

The bottom panel of the graphic block can be connected to a bottom panel of the tray along a fold line so in a shipping configuration the graphic block can be overlapped with the bottom panel of the tray with the collapsible panels collapsed, and so in a retail configuration, the graphic block can be unfolded to a position next to the tray with the collapsible panels unfolded for retail display of graphics on the front graphic panel.

A method of forming a graphic block package from a blank includes forming a tray and a graphic block from a single blank, wherein the graphic block is foldably connected to the tray for collapse the graphic block for shipping and to support the graphic block for retail display, wherein the tray and the graphic block are integrally connected to each other along at least one fold line. Forming the tray and graphic block can include adhering an adhesive tab to foldably connect a side panel of the graphic block to a bottom panel of the graphic block, and collapsing the graphic block by folding the side panel of the graphic block along a fold line through the side panel of the graphic block to overlap the bottom panel of the graphic block with a front graphic panel that is foldably connected to the side panel of the graphic block. The method can include overlapping the collapsed graphic block with a bottom panel of the tray by folding along a fold line connecting the graphic block to the tray.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
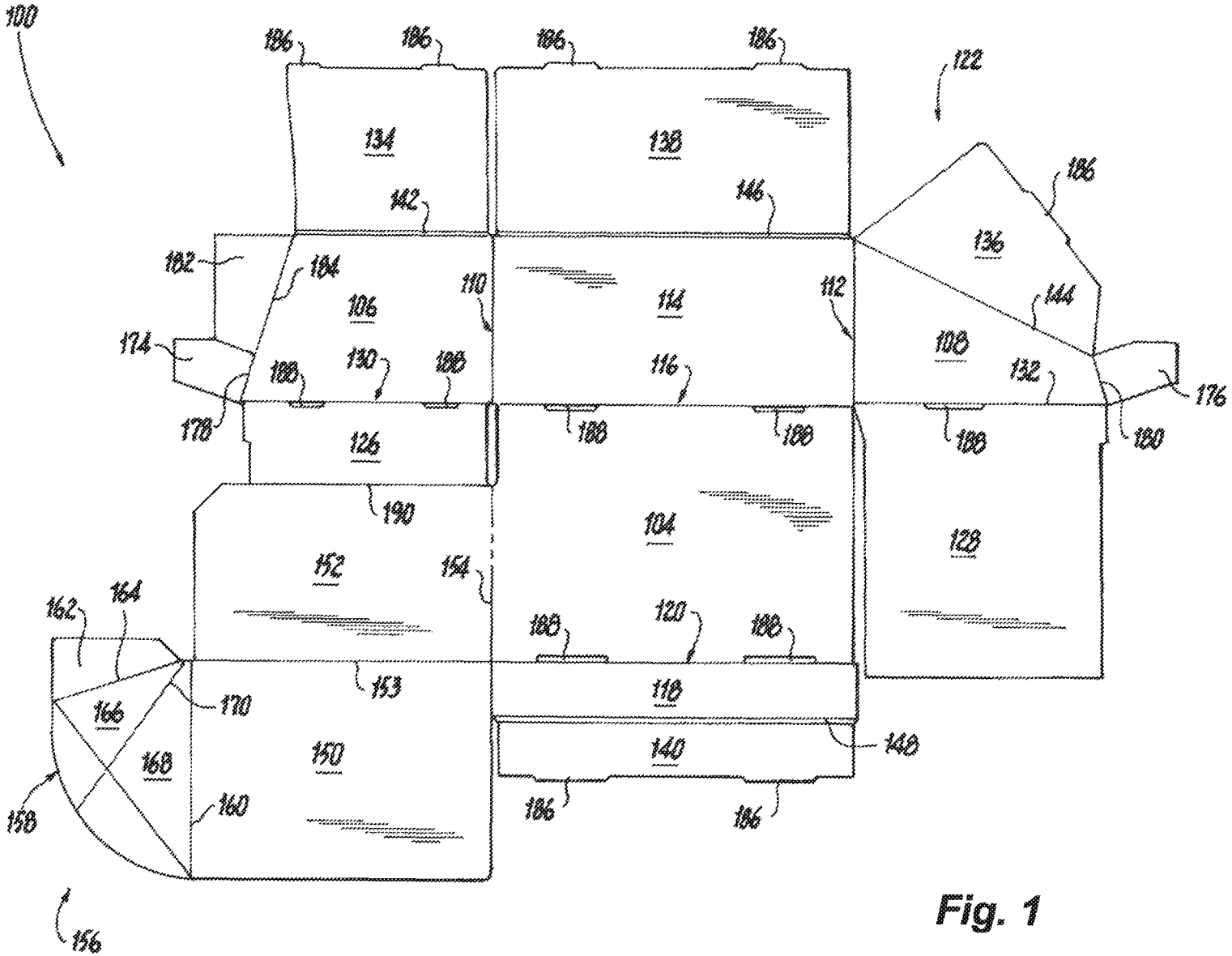
FIG. 1 is a plan view of an exemplary embodiment of a package blank constructed in accordance with the present disclosure, showing the panels for the tray and the panels for the graphic block.

Reference will now be made to the drawings wherein like reference numerals identify similar structural features or aspects of the subject disclosure. For purposes of explanation and illustration, and not limitation, a partial view of an exemplary embodiment of a blank for a package in accordance with the disclosure is shown in FIG. 1 and is designated generally by reference character 100. Other embodiments of blanks and packages in accordance with the disclosure, or aspects thereof, are provided in FIGS. 2-23, as will be described. The systems and methods described herein can be used to provide one-piece graphic display packaging for shipping and displaying product, e.g., in a retail setting.

Figure 19:
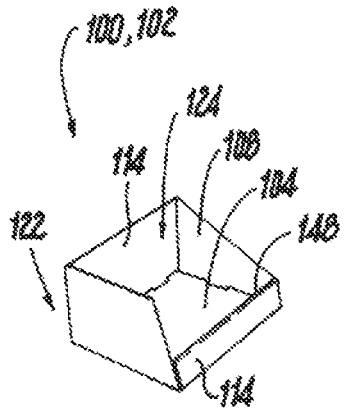
Figure 20:
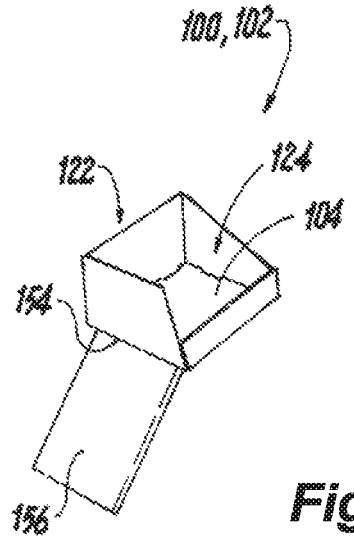
FIGS. 20-23 are perspective views of the blank of FIG. 1, showing stages of deploying the graphic block for retail display.
Figure 21:
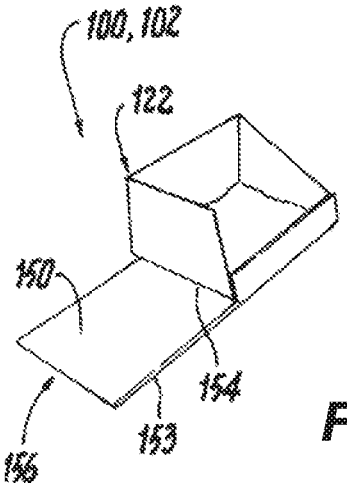
Figure 22:
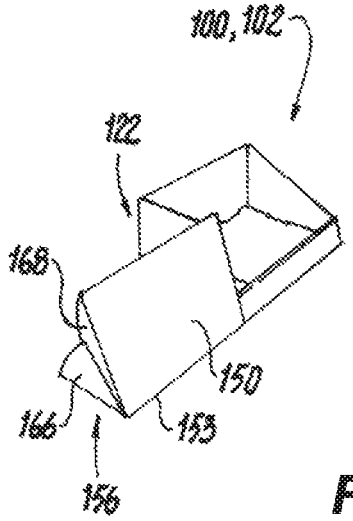
Figure 23:
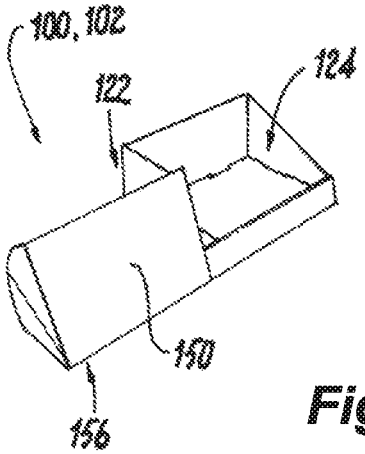

The blank 100 is for making a graphic block package 102, which is shown in FIG. 19 in a shipping configuration, and in FIG. 23 in a retail configuration. The blank 100 includes a bottom panel 104, a back panel 114 connected to the bottom panel 104 by a respective fold line 116, two side panels 106 and 108 connected on either end of the back panel 104 by respective fold lines 110 and 112, and a front panel 118 foldably connected to the bottom panel 104 across from the back panel 114 by a respective fold line 120. The panels 104, 106, 108, 114, and 118 are configured to forming a tray 122 configured partially enclose an internal volume 124 to package and display product placed therein as shown in FIGS. 19-23. The bottom panel 104 is a compound panel including panel portions 126 and 128, foldably connected to side panels 106 and 108 by fold lines 130 and 132, respectively. The panel portions 126 and 128 overlap with the bottom panel 104 in the package 102 of FIGS. 19 and 23. The side panel 106, side panel 108, back panel 114, and front panel 118 are also each compound panels including respective panel portions 134, 136, 138, and 140 connected thereto by fold lines 142, 146, 144, and 148, respectively, that can each be folded to form a respective double panel in the package 102 of FIGS. 19-23. The panel portion 126 is separated from the bottom panel 152 of the graphic block along a cut line 190.

Figure 7:
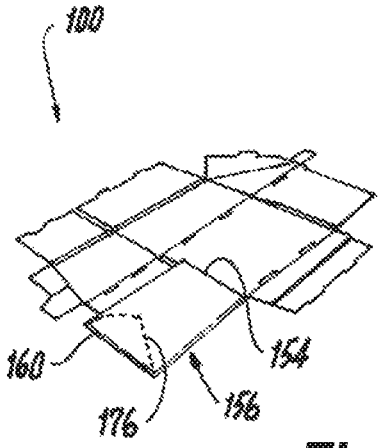

With continued reference to FIG. 1, the graphic block portion of the blank 100 includes a front graphic panel 150 foldably connected along a fold line 153 to a bottom panel 152 of the graphic block 156 (which is shown in FIG. 23). A side panel 158 of the graphic block 156 is foldably connected directly to the front graphic panel 150 along a fold line 160. An adhesive tab 162 is foldably connected along a fold line 164 to the side panel 158 of the graphic block 156 for foldably connecting the side panel 158 of the graphic block 156 to the bottom panel 152 of the graphic block 156. The panels 152, 150 and 158 are included for forming the graphic block 156 foldably connected to the tray 122 by the fold line 154 for collapse the graphic block 156 for shipping as shown in FIGS. 7 and 19, and to support the graphic block 156 in an upright state for retail display as shown in FIG. 23.

With continued reference to FIG. 1, the side panel 158 of the graphic block 156 includes a set of foldably connected collapsible panels 166 and 168 foldably connected to one another along a fold line 170. The collapsible panel 166 is foldably connected along fold line 164 to the adhesive tab 162 that can be adhered to the bottom panel 152 of the graphic block 156, foldably connecting the collapsible panel 166 to the bottom panel 152 of the graphic block 156. The collapsible panel 168 is foldably connected along the fold line 160 to the front graphic panel 150 of the graphic block 156 so that the collapsible panels 166 and 168 can fold inward between the front graphic and bottom panels 150 and 152 of the graphic block 156 for shipping as shown in FIGS. 7, and 19, and can unfold outward to form the side panel 158 of the graphic block 156 supporting the front graphic panel 150 in an upright position for retail display of graphics on the front graphic panel 150. The optional score or fold line 172 can be included across the side panel 158, intersecting with the fold line 170 to help form the side panel 158 in the upright configuration to support the front graphic panel 150 as shown in FIG. 23.

The bottom panel 152 of the graphic block 156 is foldably connected along fold line 154 to the bottom panel 104 of the tray 122. In a shipping configuration, shown in FIG. 19, the collapsed graphic block 156 can be overlapped with the bottom panel 104 of the tray 122 with the collapsible panels 166 and 168 collapsed and fold line 154 folded. In a retail configuration, the graphic block 156 can be unfolded to a position next to the tray 122 buy unfolding line 154 with the collapsible panels 166 and 168 unfolded for retail display of graphics on the front graphic panel 150 as shown in FIG. 23. The front and back panels 114 and 118 of the tray 122 are differently sized from one another for display of product in the tray 122 as shown in FIGS. 19 and 23. The side panels 106 and 108 are differently sized from one another as well.

The blank 100 includes front flaps 174 and 176 each foldably attached by a respective fold line 178 or 180 to a respective one of the side flaps 106 and 108 for securing the side panels 106 and 108 to the front panel 118. A reinforcement panel 182 is foldably connected by a fold line 184 to the side flap 106 so the reinforcement panel 182 can be adhered to the side panel 106. Each of the panels 104, 106, 108, and 118 includes one or two tabs 186, and each of the fold lines 130, 116, 132, and 120 includes one or two corresponding slots 188 for receiving the respective tabs 186 when forming the double panels described above. The blank 100 can be formed of corrugated paper board or any other suitable material.

Figure 2:
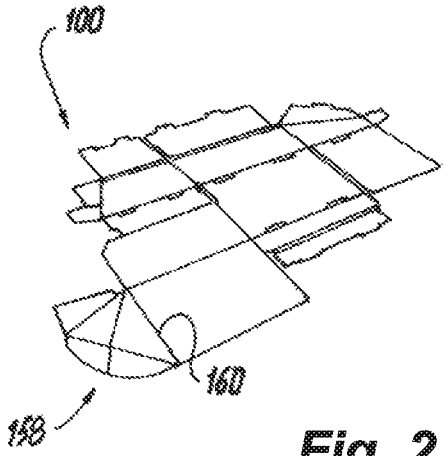
FIGS. 2-9 are perspective views of the blank of FIG. 1, showing stages of preparing the blank into a form that can be shipped flat.
Figure 3:
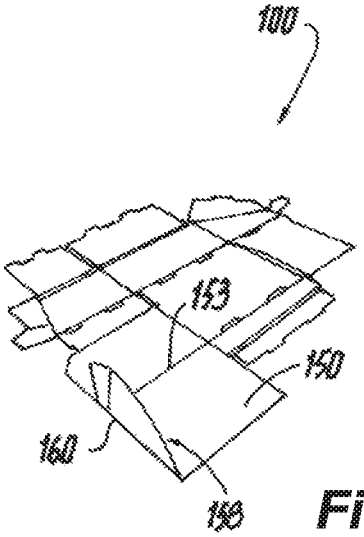
Figure 4:
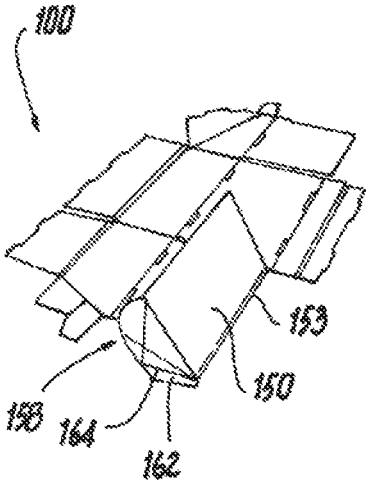
Figure 5:
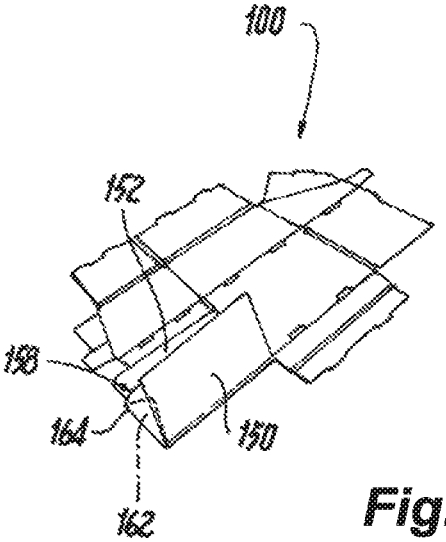
Figure 6:
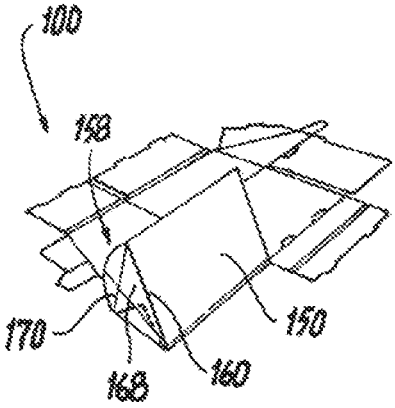

With reference now to FIGS. 2-23, a method of forming a graphic block package 102 from a blank 100 includes forming a tray 122 and a graphic block 156 from a single blank 100, wherein the graphic block 156 is foldably connected to the tray 122 for collapse the graphic block 156 for shipping and to support the graphic block 156 for retail display, wherein the tray 122 and the graphic block 156 are integrally connected to each other along a fold line 154. Starting from the blank 100 as shown in FIG. 2, the side panel 158 of the graphic block 156 is folded into the position shown in FIG. 3 along fold line 160. Fold line 153 is then folded to bring the front graphic panel 150 into the position shown in FIG. 4. The adhesive tab 162 is folded inward along fold line 164 and adhered to the bottom panel 152 of the graphic block 156 as shown in FIG. 5. The fold line 170 shown in FIG. 6 is folded inward to collapse the collapsible panels 166 and 168 to the position shown in FIG. 7 to overlap the bottom panel 152 of the graphic block 156 with the front graphic panel 150. A producer of blanks 100 could make stacks or pallets of flat blanks 100 in the form shown in FIG. 2 or in FIG. 7 at a first facility, for example, for transport to a second facility where the package 102 as shown in FIGS. 8-19 is formed for shipping product to a retail location.

Figure 8:
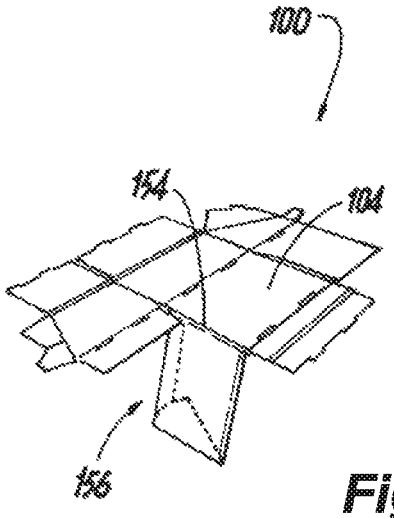
Figure 9:
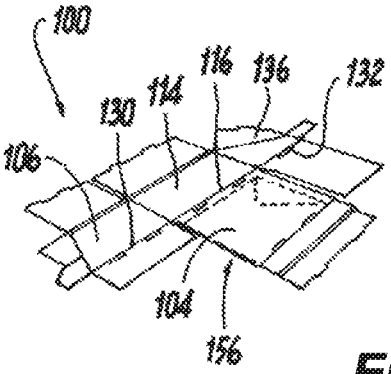
Figure 10:
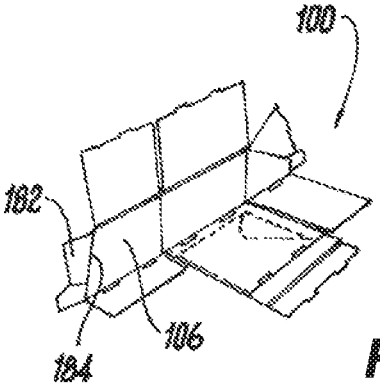
FIGS. 10-19 are perspective views of the blank of FIG. 1, showing stages of preparing the blank into a form for packaging and shipping product.
Figure 11:
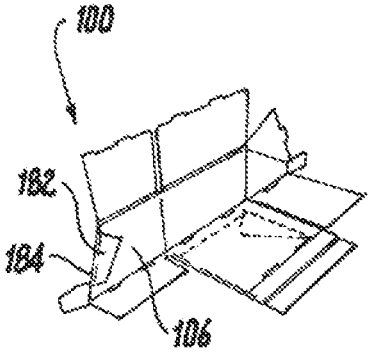
Figure 12:
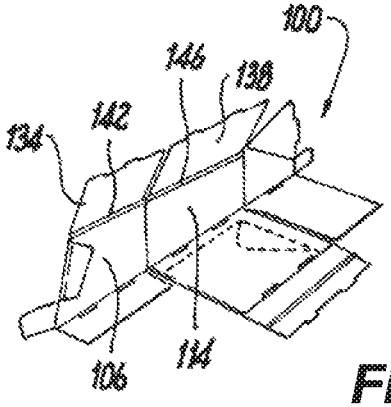
Figure 13:
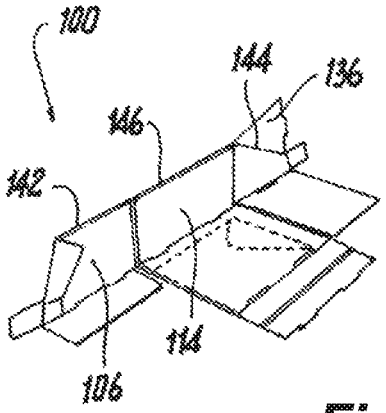
Figure 14:
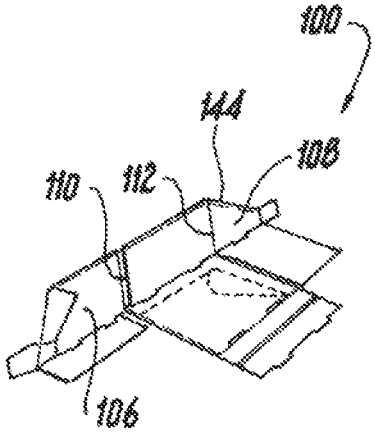
Figure 15:
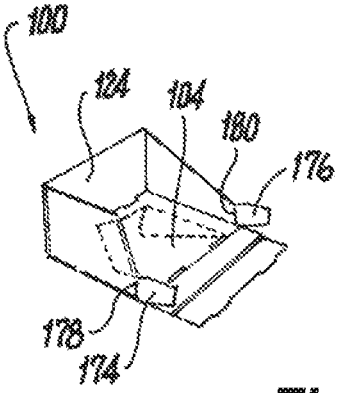
Figure 16:
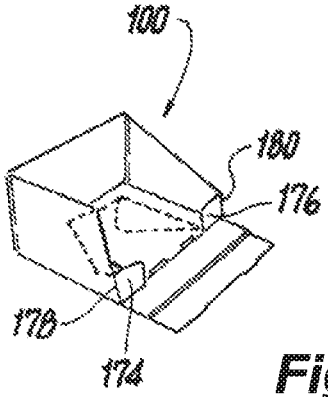
Figure 17:
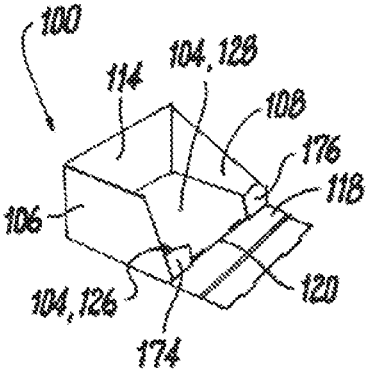
Figure 18:
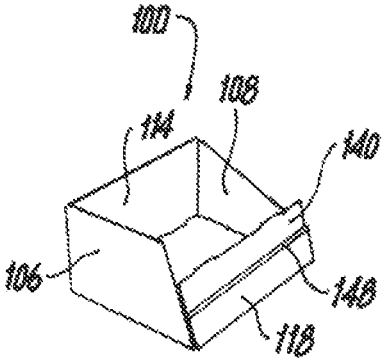

With continued reference to FIG. 7, the fold line 154 is folded through the position shown in FIG. 8 to overlap the collapsed graphic block 156 under the bottom panel 104 of the tray 122 as shown in FIG. 9. Fold lines 130, 116, and 132, which are collinear, are folded to bring the back panel 114 and side panels 106 and 108 into the position shown in FIG. 10. The reinforcement panel 182 is folded along fold line 184 to the position shown in FIG. 11, overlapping with and adhered to the side panel 106. The panel portions 134 and 138 are folded through the position shown in FIG. 12 along fold lines 142 and 146, which are collinear, to form the double panels of the side panel 106 and back panel 114 as shown in FIG. 13. While not labeled in FIG. 13, the panel portions 134 and 138 are secured in place using the corresponding tabs 186 and slots 188. The panel portion 136 is folded along the fold line 144 and is secured using the corresponding tab 186 and slot 188 (labeled in FIG. 1) to the side panel 108 to form the double panel of the side panel 108 as shown in FIG. 14. The side panels 106 and 108 are folded inward along fold lines 110 and 112 around the internal volume 124 into the position shown in FIG. 15, wherein the panel portions 126 and 128 overlap with and can be adhered to the upper surface (as oriented in FIG. 15) of the bottom panel 104 to form the double panel of the bottom panel 104. The front flaps 174 and 176 are folded along fold lines 178 and 180 to the position shown in FIG. 16. FIG. 17 shows the same position as FIG. 16 without the hidden lines. From this position, the front flap 118 can be folded along fold line 120 to the position shown in FIG. 18, where the front flap 118 can be adhered to the front flaps 174 and 176. The panel portion 140 is folded along fold line 148 into the internal volume 124 and secured in place as shown in FIG. 19 using the corresponding tabs 186 and slots 188 (not labeled in FIG. 19, but see FIG. 1). The configuration of package 102 shown in FIG. 19 is ready to receive product. The product, not shown, can be secured in the internal volume 124 and the package holding the product can be shipped in the configuration shown in FIG. 19 to a retail location.

With reference now to FIGS. 20-23, at the retail location, the graphic block 156 can be formed into an upright position for display of graphics thereon in the retail setting. From the shipping position shown in FIG. 19, the collapsed graphic block 156 is unfolded along fold line 154 through the position shown in FIG. 20 to the position shown in FIG. 21. The front graphic panel 153 can be unfolded, un-collapsing the collapsible panels 166 and 168 as shown in FIG. 22, and the collapsible panels 166 and 168 can be secured in place to form the side panel 158 of the graphic block 156 as shown in FIG. 23. In the position shown in FIG. 23, the graphics on the front graphic panel 150 can be displayed next to product seated in the internal volume 124 for retail display. Optionally, adhesive tab 162 (shown in FIG. 1) can be left unadhered to the bottom panel 152 of the graphic display, and can be unfolded from the position shown in FIG. 23 to stand the front graphic panel 150 completely vertical relative to the bottom panel 152 rather than resting at the angle shown in FIG. 23.

While shown and described above with the graphic block 156 on the left hand side of the tray 122 as shown in FIG. 23, those skilled in the art will readily appreciate that the graphic block 156 could be formed on the right side instead, e.g., by making all the folds described above in the opposite direction. Systems and methods as disclosed herein provide potential advantages over traditional packaging, such as compact shipping in palletized form as shown in FIGS. 2 and 7, efficient use of material, reduced machinery in manufacturing, and simplified assembly.

The methods and systems of the present disclosure, as described above and shown in the drawings, provide for graphic block packaging with superior properties including one-piece construction. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A graphic block package comprising:

a tray configured to package and display product placed therein; and a graphic block foldably connected to the tray, wherein the graphic block includes a set of folding panels configured to collapse the graphic block for shipping and to support the graphic block for retail display;

wherein the folding panels of the graphic block include a front graphic panel, a bottom panel, and side panel orthogonal to both the front graphic panel and the bottom panel;

wherein the side panel of the graphic block includes a set of foldably connected collapsible panels, wherein a first one of the collapsible panels is foldably connected to the bottom panel of the graphic block, and wherein a second one of the collapsible panels is foldably connected to the front graphic panel so that the collapsible panels can fold inward between the front graphic and bottom panels of the graphic block for shipping, and can unfold outward to form the side panel of the graphic block supporting the front graphic panel in an upright position for retail display of graphics on the front graphic panel.

2. The package as recited in claim 1, wherein the tray includes a bottom panel, two side panels on either end of the bottom panel, a back panel connected to the bottom panel, and a front panel connected to the bottom panel across from the back panel.

3. The package as recited in claim 2, wherein at least one of the bottom, side, and front panels of the tray is a compound panel including a respective fold line that can be folded to form a respective double panel.

4. The package as recited in claim 2, wherein at least one of:

the front and back panels of the tray are differently sized from one another for display of product in the tray; and the first and second side panels are differently sized from one another.

5. The package as recited in claim 1, wherein the first one of the collapsible panels is foldably connected to an adhesive tab that is adhered to the bottom panel of the graphic block, foldably connecting the first one of the collapsible panels to the bottom panel of the graphic block.

6. The package as recited in claim 5, wherein the bottom panel of the graphic block is connected to a bottom panel of the tray along a fold line so in a shipping configuration the graphic block can be overlapped with the bottom panel of the tray with the collapsible panels collapsed, and so in a retail configuration, the graphic block can be unfolded to a position next to the tray with the collapsible panels unfolded for retail display of graphics on the front graphic panel.

7. The package as recited in claim 1, wherein the tray and graphic block are integrally connected together as one piece.

8. A blank for a graphic block package comprising:

a plurality of panels for forming a tray configured to package and display product placed therein; and a plurality of panels for forming a graphic block foldably connected to the tray for collapsing the graphic block for shipping and to support the graphic block for retail display;

wherein the folding panels of the graphic block include a front graphic panel foldably connected to a bottom panel of the graphic block, and a side panel of the graphic block foldably connected directly to the front graphic panel, with an adhesive tab foldably connected to the side panel of the graphic block for foldably connecting the side panel of the graphic block to the bottom panel of the graphic block wherein the side panel of the graphic block includes a set of foldably connected collapsible panels, wherein a first one of the collapsible panels is foldably connected to the adhesive tab for connection to the bottom panel of the graphic block, and wherein a second one of the collapsible panels is foldably connected to the front graphic panel so that the collapsible panels can fold inward between the front graphic and bottom panels of the graphic block for shipping, and can unfold outward to form the side panel of the graphic block supporting the front graphic panel in an upright position for retail display of graphics on the front graphic panel.

9. The blank as recited in claim 8, wherein the plurality of panels for forming a tray includes a bottom panel, a back panel connected to the bottom panel by a respective fold line, two side panels connected on either end of the back panel by respective fold lines, and a front panel foldably connected to the bottom panel across from the back panel by a respective fold line.

10. The blank as recited in claim 9, wherein at least one of the bottom, side, and/or front panels of the tray is a compound panel including a respective fold line that can be folded to form a respective double panel.

11. The blank as recited in claim 9, wherein at least one of:

the front and back panels of the tray are differently sized from one another for display of product in the tray; and the first and second side panels are differently sized from one another.

12. The blank as recited in claim 8, wherein the first one of the collapsible panels is foldably connected to an adhesive tab that is adhered to the bottom panel of the graphic block, foldably connecting the first one of the collapsible panels to the bottom panel of the graphic block.

13. The blank as recited in claim 12, wherein the bottom panel of the graphic block is connected to a bottom panel of the tray along a fold line so in a shipping configuration the graphic block can be overlapped with the bottom panel of the tray with the collapsible panels collapsed, and so in a retail configuration, the graphic block can be unfolded to a position next to the tray with the collapsible panels unfolded for retail display of graphics on the front graphic panel.

* * * * *